US010513320B2

(12) United States Patent
Manning, Sr. et al.

(10) Patent No.: US 10,513,320 B2
(45) Date of Patent: Dec. 24, 2019

(54) TROLLING MOTOR ADAPTOR AND METHODS OF MAKING AND USING THE SAME

(71) Applicant: Moore Holding Group, LLC, Cary, NC (US)

(72) Inventors: Jimmy Lee Manning, Sr., Durham, NC (US); Harold Spencer, Durham, NC (US); Allen W. Moore, Cary, NC (US); Jordan R. Long, Durham, NC (US); Samuel C. Felts, Jr., Raleigh, NC (US)

(73) Assignee: Moore Holding Group, LLC, Cary, NC (US)

( * ) Notice: Subject to any disclaimer, the term of this patent is extended or adjusted under 35 U.S.C. 154(b) by 196 days.

(21) Appl. No.: 15/910,055

(22) Filed: Mar. 2, 2018

(65) Prior Publication Data

US 2018/0273151 A1 Sep. 27, 2018

Related U.S. Application Data

(60) Provisional application No. 62/601,402, filed on Mar. 21, 2017.

(51) Int. Cl.

| | |
|---|---|
| ***B63H 1/20*** | (2006.01) |
| ***B63H 20/00*** | (2006.01) |
| ***B63H 5/16*** | (2006.01) |

(52) U.S. Cl.

CPC ..... *B63H 1/20* (2013.01); *B63H 5/165* (2013.01); *B63H 20/007* (2013.01); *B63B 2755/00* (2013.01)

(58) Field of Classification Search

CPC ..... B63H 1/20; B63H 5/165; B63H 20/007; B63B 2755/00

USPC ..... 440/6, 71, 72, 73

See application file for complete search history.

(56) References Cited

U.S. PATENT DOCUMENTS

| | | | | | |
|---|---|---|---|---|---|
| 4,180,368 | A | * | 12/1979 | Henrich | B63H 1/26 416/134 R |
| 4,211,515 | A | * | 7/1980 | Henrich | B63H 1/26 416/146 R |
| 4,898,552 | A | * | 2/1990 | Cochran, IV | B63H 5/165 416/247 A |
| 5,007,867 | A | * | 4/1991 | Kelley | B63H 5/165 416/247 A |

* cited by examiner

*Primary Examiner* — Anthony D Wiest
(74) *Attorney, Agent, or Firm* — NK Patent Law

(57) ABSTRACT

The presently disclosed subject matter is directed to an adaptor that can be used to eliminate the gap present between the motor housing and the propeller in conventional trolling motors. Particularly, the disclosed adaptor comprises a first shell and a second shell that attach together and surround the base of the trolling motor propeller therebetween. As shown, the propeller blades extend from one or more apertures in the adaptor. The adaptor attaches to the trailing end of the motor housing and is maintained on the drive shaft through the use of one or more fasteners.

13 Claims, 13 Drawing Sheets

TROLLING MOTOR ADAPTOR AND METHODS OF MAKING AND USING THE SAME

CROSS REFERENCE TO RELATED APPLICATION

This application claims priority to U.S. Provisional Patent Application No. 62/601,402 filed Mar. 21, 2017, the content of which is hereby incorporated by reference in its entirety.

TECHNICAL FIELD

The presently disclosed subject matter relates to an adaptor for use with a trolling motor. Specifically, the presently disclosed subject matter is directed to an adaptor for preventing the migration of fishing line, vegetation, and other foreign items between a trolling motor propeller and a trolling motor housing.

BACKGROUND

Propeller-driven marine motors (such as trolling motors for fishing boats) are well known in the art and have been used by fishermen for many years. Trolling motors are typically small, insulated electric motors that are mounted on the lower end of a hollow tube. During use, the hollow tube is vertically aligned so that the motor body is submerged beneath the water. The electric motor drives a rotatable propeller at the trailing end of the motor body. The tube is also configured to be rotatable to change the direction of thrust of the propeller to steer the boat. One problem prevalent with trolling motors is the tendency of weeds, fishing line, and other foreign materials to wind on the drive shaft, between the propeller and the motor housing. As a result, the motor encounters heat buildup and increased power drain on the battery. Further, pressure on the bearings and housing supporting the driveshaft can be increased, resulting in reduced motor life. In addition, removing the buildup between the propeller and the motor housing is time consuming and requires special tools that the fisherman may not have on hand. It would therefore be beneficial to provide an adaptor that overcomes the shortcomings in the prior art.

SUMMARY

In some embodiments, the presently disclosed subject matter is directed to an adaptor comprising a first adaptor shell defining a sleeve that includes a connector portion that extends from an end thereof, the connector portion defining a cutout for receiving a blade of a propeller. The adaptor further comprises a second adaptor shell configured for engaging the first adaptor shell, wherein the second adaptor shell defines an end surface about which a fastener engages a rotating shaft that carries the propeller, and further defining a cutout for receiving the blade of the propeller when the first and second adaptor shells are thereby engaged with each other.

In some embodiments, the second adaptor shell further comprises a wall that extends from the end surface that includes one or more attachments that connect to more one or more attachments positioned on the connector portion of the first adaptor shell when the first and second adaptor shells are engaged with each other.

In some embodiments, the attachments are connected together through friction fit, snap-fit, mechanical interlock, or combinations thereof.

In some embodiments, the attachments are configured as ridges and the second adaptor shell attachments are configured as grooves.

In some embodiments, the connector portion has an outer diameter that is at least about 2% less than the outer diameter of the sleeve.

In some embodiments, the end surface of the second adaptor shell comprises an aperture through which the rotating shaft can pass.

In some embodiments, the cutouts are triangular-shaped.

In some embodiments, the presently disclosed subject matter is directed to a method of installing an adaptor on a boat motor that comprises a main cylindrical housing from which a drive shaft extends and a propeller comprising a hub and a plurality of blades extending from the hub. The method comprises providing an adaptor comprising a first adaptor shell defining a sleeve that includes a connector portion that extends from an end thereof, the connector portion defining a cutout for receiving a blade of a propeller; and a second adaptor shell configured for engaging the first adaptor shell, wherein the second adaptor shell defines an end surface about which a fastener engages a drive shaft that carries the propeller, and further defining a cutout for receiving the blade of the propeller when the first and second adaptor shells are thereby engaged with each other. The method further comprises attaching the first adaptor shell to the hub, wherein a blade extends through each cutout of the connector portion. The method further comprises inserting the sleeve of the first adaptor shell over one end of the main cylindrical housing, wherein the drive shaft extends through an aperture in the propeller. The method further comprises engaging the first adaptor shell and the second adaptor shell, wherein the drive shaft passes through the end surface of the second adaptor shell and wherein rotation of the propeller imparts a corresponding rotation to the sleeve.

In some embodiments, the sleeve is permanently secured to at least one of the first and second adaptor shells.

In some embodiments, the method further comprises coupling a fastener to a portion of the drive shaft that extends from the end surface of the second adaptor shell.

In some embodiments, the connector portion has an outer diameter that is at least about 2% less than the outer diameter of the sleeve.

In some embodiments, the presently disclosed subject matter is directed to a propeller for a boat motor of the type having a main cylindrical housing from which a drive shaft extends. The disclosed propeller comprises a hub, a plurality of blades extending from the hub, and a sleeve extending from the hub towards the main cylindrical housing when the propeller is installed about the motor, wherein the sleeve defines a major inner diameter that is greater than the major outer diameter of the housing and extends above at least a portion of the housing.

In some embodiments, the hub defines a face about which a fastener engages a rotating drive shaft.

In some embodiments, the face comprises a recessed portion that includes an aperture for engaging the rotating drive shaft.

In some embodiments, the hub has an outer diameter that is at least about 2% less than the outer diameter of the sleeve.

In some embodiments, the plurality of blades are disposed symmetrically about the hub.

In some embodiments, there are 2, 3, or 4 blades.

BRIEF DESCRIPTION OF THE DRAWINGS

The previous summary and the following detailed descriptions are to be read in view of the drawings, which illustrate some (but not all) embodiments of the presently disclosed subject matter.

DETAILED DESCRIPTION

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "an adaptor" can include a plurality of such adaptors, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

Figure 1:
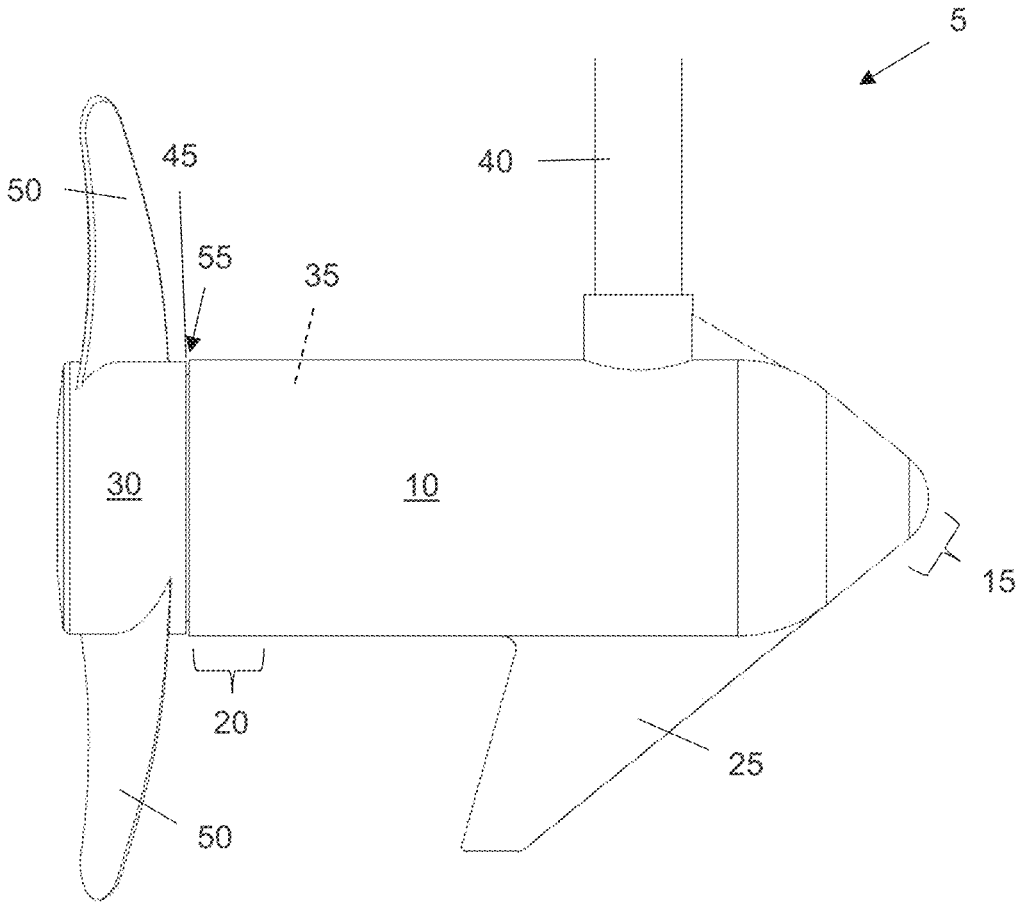
FIG. 1 is a side plan view of a representative prior art trolling motor.

One embodiment of a conventional trolling motor is illustrated in FIG. 1. Particularly, trolling motor 5 includes bullet-shaped motor housing 10 comprising leading end 15 and trailing end 20. As shown, in some embodiments, leading end 15 can have a streamlined shape and can include bottom fin 25 to more easily move through the water when in use. The housing encases electric motor 35 which powers a drive shaft for rotating propeller 30. Housing 10 is connected to control post 40 through which control cabling is run. Control post 40 can also be manually rotated by an operator to control the direction of propulsion. Trailing end 20 can be removably connected to propeller 30 at joint 45 via drive shaft 46 (not shown). In use, motor 35 spins the drive shaft which in turn spins the propeller to move the boat through the water. Propeller 30 includes blades 50 that function to increase the propulsion of the propeller. As shown, gap 55 is present at the joint between propeller 30 and motor housing 10. Gap 55 is problematic because vegetation, fishing line, and other foreign objects can become lodged in the gap, causing damage to the propeller, drive shaft, motor, and/or housing.

Figure 2A:
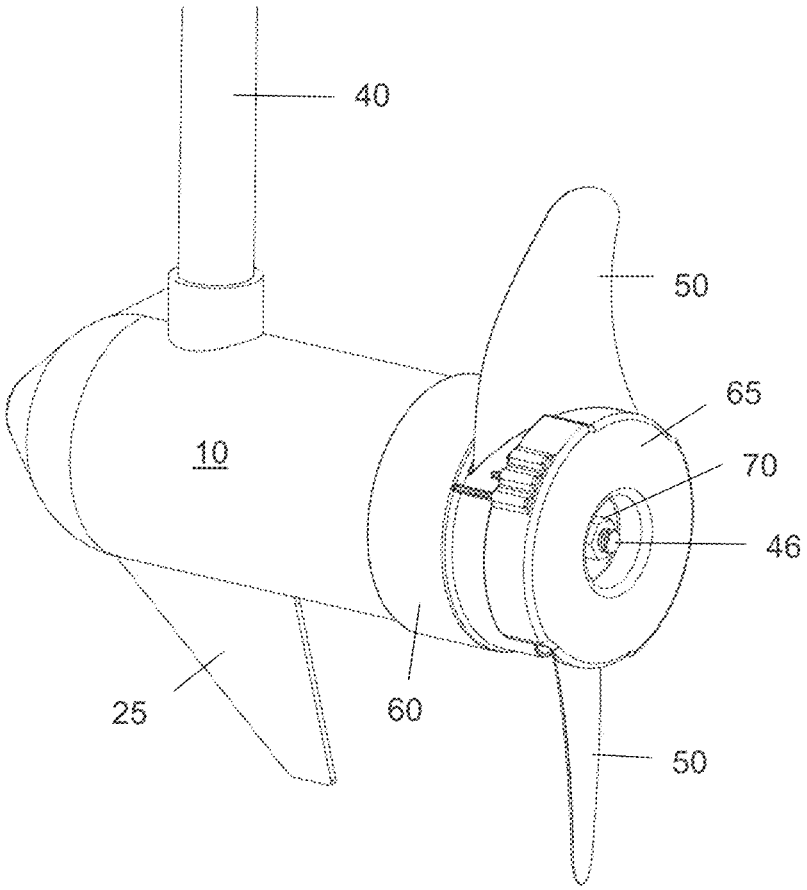
FIG. 2*a* is a perspective view of a trolling motor comprising an adaptor in accordance with some embodiments of the presently disclosed subject matter.
Figure 2B:
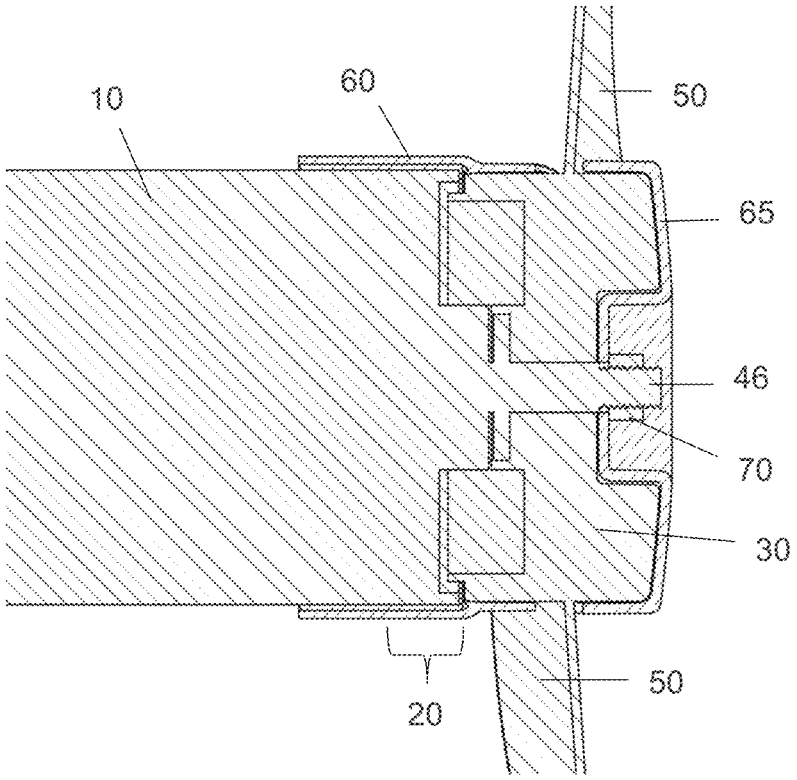
FIG. 2*b* is a sectional view of the adaptor of FIG. 2*a*.
Figure 2C:
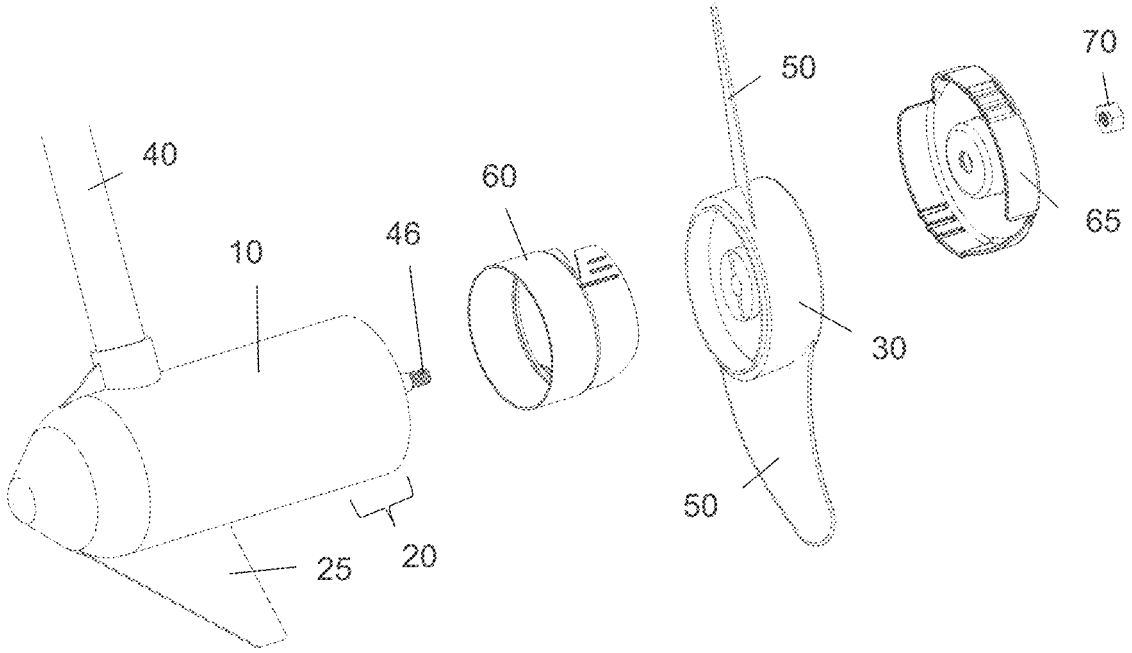
FIG. 2*c* is an exploded view of the trolling motor of FIG. 2*a*.

The presently disclosed subject matter is directed to an adaptor that can be used to eliminate gap 55 between the motor housing and the propeller in conventional trolling motors. Particularly, as shown in FIGS. 2*a*-2*c*, the disclosed adaptor comprises first adaptor shell 60 and second adaptor shell 65 that attach together and surround the base of propeller 30 therebetween. As shown, propeller blades 50 extend from one or more apertures in the adaptor. The adaptor attaches to trailing end 20 of the motor housing and is maintained on drive shaft 46 through the use of fastener 70.

Figure 3A:
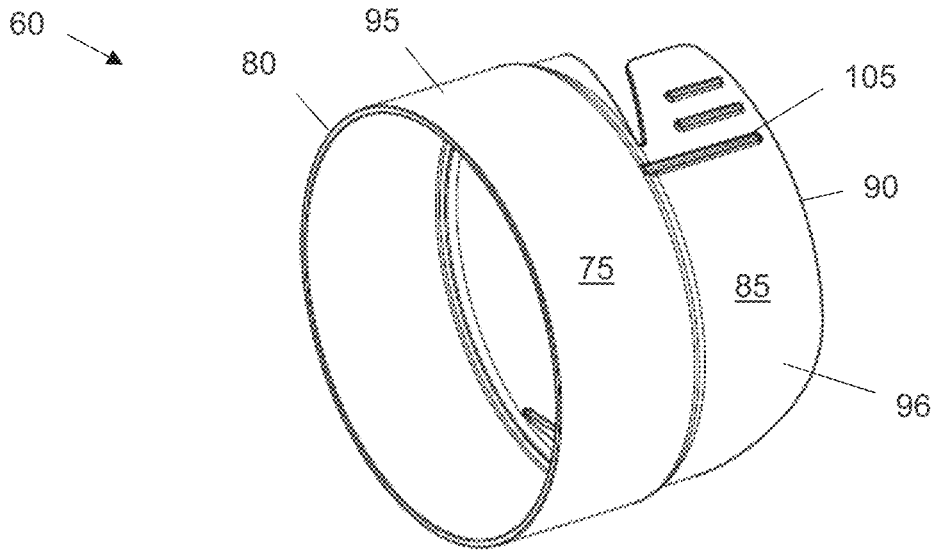
FIGS. 3*a* and 3*b* are perspective views of a first adaptor portion in accordance some embodiments of the presently disclosed subject matter.
Figure 3B:
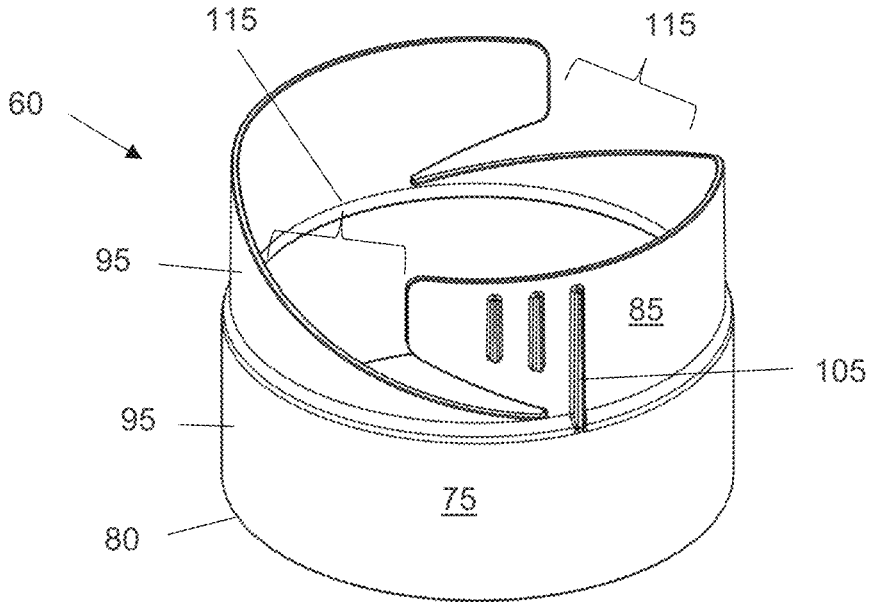

FIGS. 3*a* and 3*b* illustrate one embodiment of adaptor first shell 60 comprising sleeve 75 positioned at first end 80 and connector portion 85 positioned at second end 90. Sleeve 75 comprises wall 95 which defines a hollow interior. The sleeve is sized and shaped to fit over trailing end 20 of the motor housing. For example, in some embodiments, sleeve 75 can be configured with a circular cross-section to surround and receive trailing end 20 of the motor housing. However, the shape of sleeve 75 is not limited and can be constructed in any desired shape to fit over any correspondingly-shaped motor housing. The outer diameter of sleeve 75 can be slightly larger (e.g., 1, 2, 3, 4, 5, 6, 7, 8, 9, or 10% larger) than the outer diameter of motor housing trailing end 20 to allow the sleeve to fit over the housing. In some embodiments, the sleeve can be maintained on trailing end 20 through the use of one or more adhesives. However, the presently disclosed subject matter is not limited and any known mechanism can be used to permanently or removably connect sleeve 75 to trailing end 20 of housing 10 (e.g., mechanical closures, welding, and the like).

In some embodiments, connector portion 85 is sized and shaped to interlock with adaptor second shell 65. For example, the connector portion can comprise cylindrically-shaped wall 96 that defines a hollow interior. Wall 96 can include an exterior surface that comprises one or more raised ridges 105. The ridges slide into and snapably lock into grooves 110 positioned on the adaptor second shell to lock the first and second adaptor shells together. In some embodiments, connector 85 and adaptor second shell 65 are releasably connected together. Ridges 105 can be configured in any desired shape, such as (but not limited to) rectangular, square, triangular, and the like. The connector can include any desired number of ridges (e.g., 1, 2, 3, 4, 5, 6, 7, and the like). It should be appreciated that connector portion 105 and second adaptor shell 65 are not limited to the ridges and grooves disclosed herein. Rather, the connector and second adaptor shell can be interlocked using any known connection mechanism, including (but not limited to) friction fit, snap-fit, mechanical interlock, and the like. It should further be appreciated that the presently disclosed subject matter includes embodiments wherein second connector portion 105 and second adaptor shell 65 lack grooves and/or ridges.

Wall 96 of connector portion 85 further comprises one or more openings 115 that are sized and shaped to receive propeller blades 50. Thus, as shown, in some embodiments, openings 115 can be angled and/or can extend the full width of wall 95 to abut sleeve 75. It should be appreciated that openings 115 can be customized to fit any desired propeller (e.g., propellers with 2, 3, 4, etc. blades).

In some embodiments, the outer diameter of connector wall 96 is slightly less than the outer diameter of sleeve 75 (e.g., 1%, 2%, 3%, 4%, 5%, 6%, 7%, 8%, 9%, or 10% less). However, the presently disclosed subject matter is not limited and also includes embodiments wherein the connector wall has an outer diameter that is about the same or greater than the sleeve.

In some embodiments, adaptor first shell 60 can be constructed as a single unit. However, the presently disclosed subject matter also includes embodiments where the sleeve and connector portion are separately constructed and are permanently joined together using welding, adhesive, and the like. Alternatively, sleeve 75 and connector portion 85 can be releasably joined together using any of a wide variety of mechanical closures known and used in the art (e.g., screws, bolts, rivets, and the like). As shown in the figures, the first connection shell is open at both ends to allow the drive shaft to pass therethrough.

Figure 4:
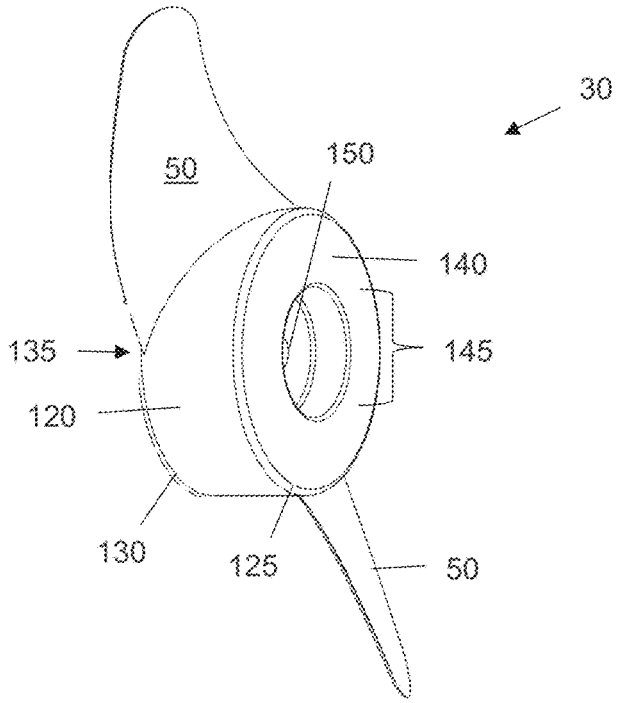
FIG. 4 is a perspective view of a conventional propeller in accordance with some embodiments of the presently disclosed subject matter.

FIG. 4 illustrates one embodiment of a conventional propeller. As shown, propeller 30 comprises cylindrical hub 120 and a plurality of blades 50 extending radially outwardly from the hub. Hub 120 comprises front end 125, rear end 130, and open cavity 135 formed along the axis thereof. Hub 120 further includes hub face 140 positioned at front end 125. Optionally, hub face 140 can include recess 145 that extends from the face into cavity 135. Recess 145 can be configured with a spherical cross section with hole 150 for receiving a motor drive shaft.

Figure 5A:
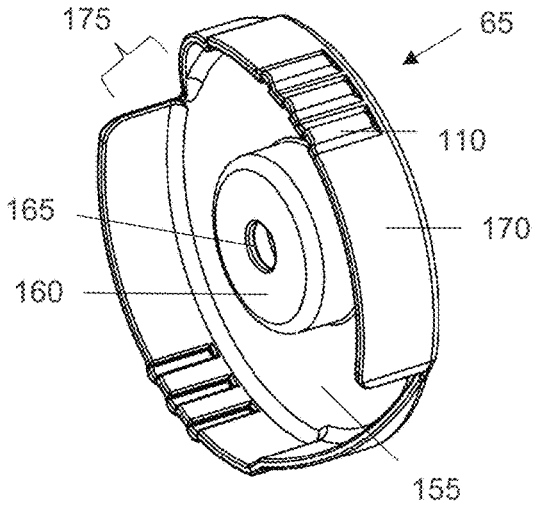
FIGS. 5*a*-5*c* are perspective views of a second adaptor portion in accordance with some embodiments of the presently disclosed subject matter.
Figure 5B:
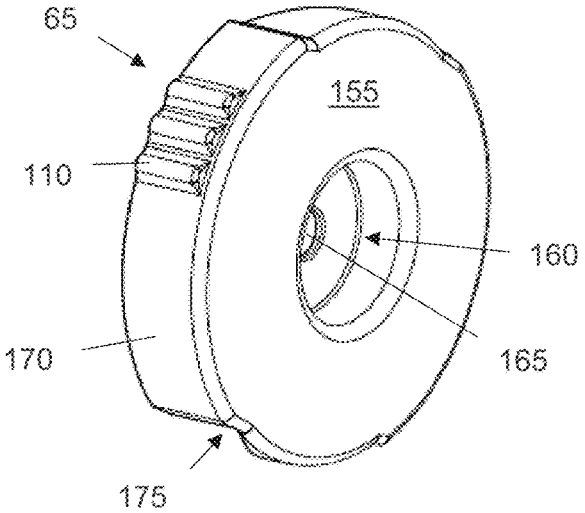
Figure 5C:
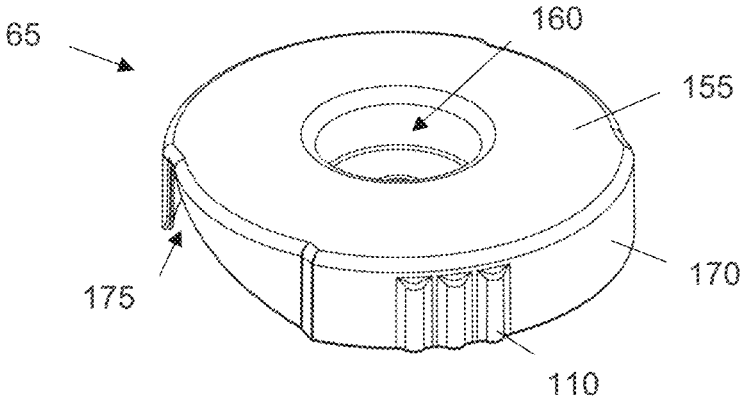

FIGS. 5*a*-5*c* illustrate one embodiment of second adaptor shell 65 that releasably or permanently connects to first adaptor shell 60. As shown, the second adaptor shell is sized and shaped to fit over front end 125 of propeller 30. Particularly, the second adaptor shell comprises face 155 and optionally recess 160 that extends away from the face. Recess 160 can be configured as a center portion with hole 165 that receives a motor drive shaft. However, it should be appreciated that the size and shape of recess 160 is not limited and can be configured to mirror propeller recess 145. In some embodiments, the second adaptor shell further comprises wall 170 configured about the circumference of and extending perpendicularly away from face 155. Wall 170 can comprise one or more grooves 110 that interlock with ridges 105 that are optionally included on the adaptor first shell. It should be appreciated that second adaptor shell 65 is not limited to grooves 110 and the first and second adaptor shells can be interlocked using any known connection mechanism. Alternatively, the first and second adaptor shells can lack ridges and grooves and can be coupled through connection to the drive shaft. Wall 170 further comprises one or more openings 175 sized and shaped to receive propeller blades 50 when the propeller is positioned between the first and second adaptor units. It should be appreciated that first openings 115 cooperate with second openings 175 to allow the propeller blades to extend therethrough.

In some embodiments, the outer diameter of face 155 is slightly larger than the outer diameter of propeller face 140 to allow adaptor second shell 65 to fit over the propeller front end 125. Likewise, the outer diameter of wall 170 can be slightly larger than the outer diameter of hub 120. In some embodiments, the outer diameter of wall 170 is about the same as the outer diameter of sleeve 75 such that when the adaptor is assembled it has a uniform diameter. Further, in some embodiments, recess 160 can be slightly smaller than propeller recess 145 to allow the adaptor recess to fit into the propeller recess when coupled together. The term "slightly" as used herein can include (but is not limited to) about 1, 2, 3, 4, 5, 6, 7, 8, 9, or 10%.

Although configured as circular in the drawings, face 155 and recess 160 can be constructed in any desired shape, so long as they allow the adaptor second shell to fit over the front end of propeller 30. Further, although the hole is depicted as circular in shape, it can be configured in any desired shape so long as it allows drive shaft 46 to pass therethrough.

First and second adaptor shells 60, 65 can be constructed from any rigid or semi-rigid material known or used in the art. For example, the first and second adaptor shells can be constructed from one or more metallic and/or polymeric materials. Suitable metallic materials can include (but are not limited to) stainless steel, aluminum, bronze, nickel, and alloys or combinations thereof. Suitable polymeric materials can include (but are not limited to) polyurethane, polystyrene, epoxy polymer, polyvinyl chloride, silicone polymer, acrylic polymer, and combinations thereof.

First and second adaptor shells 60, 65 can be constructed using any method known or used in the art. For example, in some embodiments, one or more of welding, injection molding, extrusion, thermoforming, or machining can be used.

Figure 6:
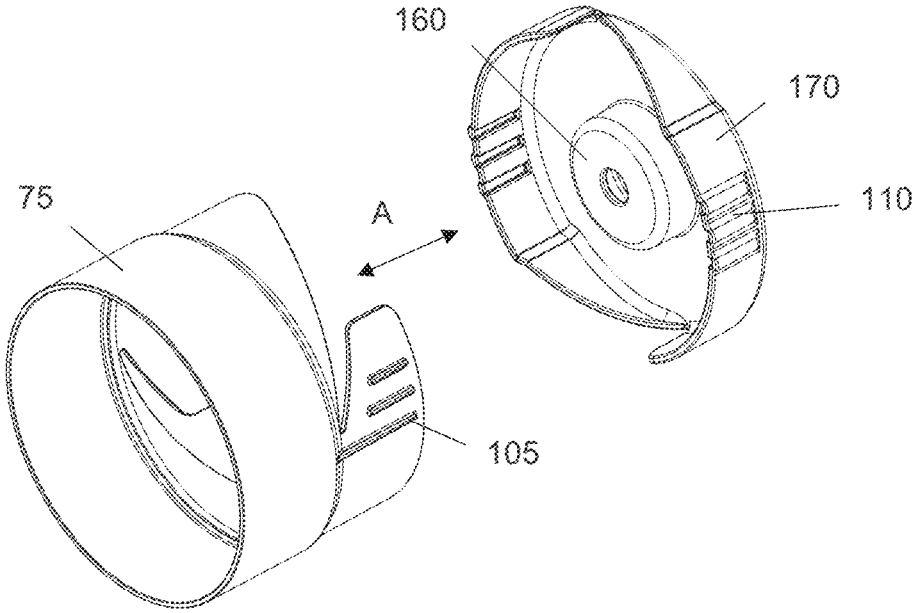
FIG. 6 is a perspective view of the first and second adaptor portions in accordance with some embodiments of the presently disclosed subject matter.

FIG. 6 illustrates one mechanism by which the first and second adaptor shells can be releasably joined together. Particularly, as shown, ridges 105 of the first connector shell are aligned with grooves 110 positioned on the wall of the second connector shell. The two adaptor shells are then translated towards each other, as illustrated by Arrow A. In this way, ridges 105 are received within grooves 110 and the first and second adaptor shells are releasably joined together. The first and second shells can be separated on demand using the application of pressure. Alternatively, the adaptor assembly can be permanently adhered together through the use of welding, adhesives, and the like.

Figure 7A:
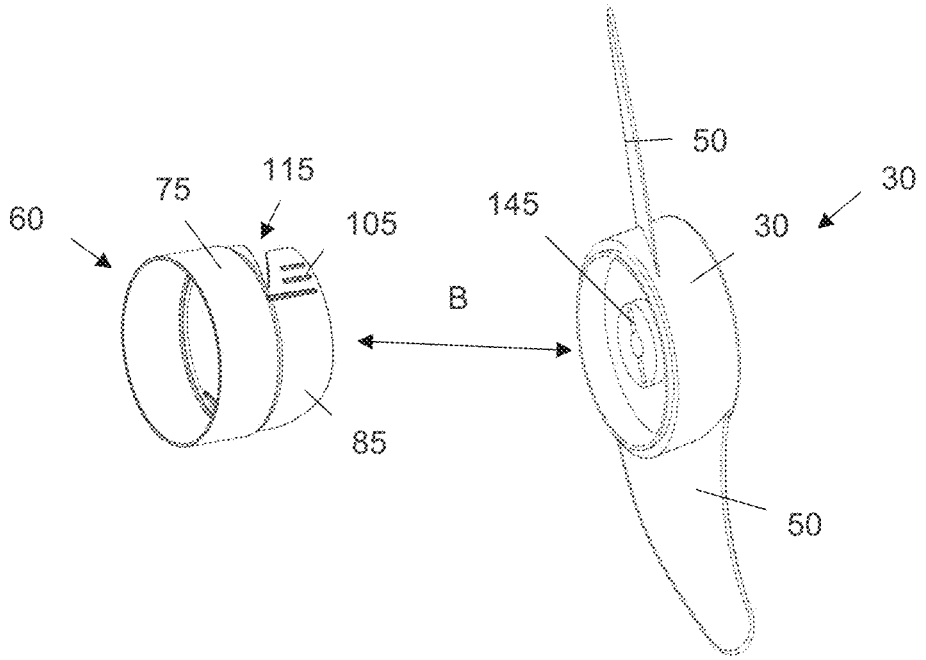
FIGS. 7*a*-7*d* are perspective views illustrating assembly of the adaptor in accordance with some embodiments of the presently disclosed subject matter.
Figure 7B:
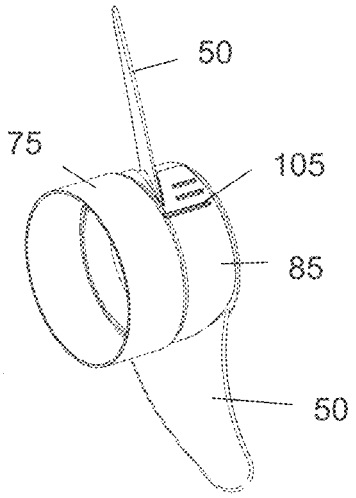
Figure 7C:
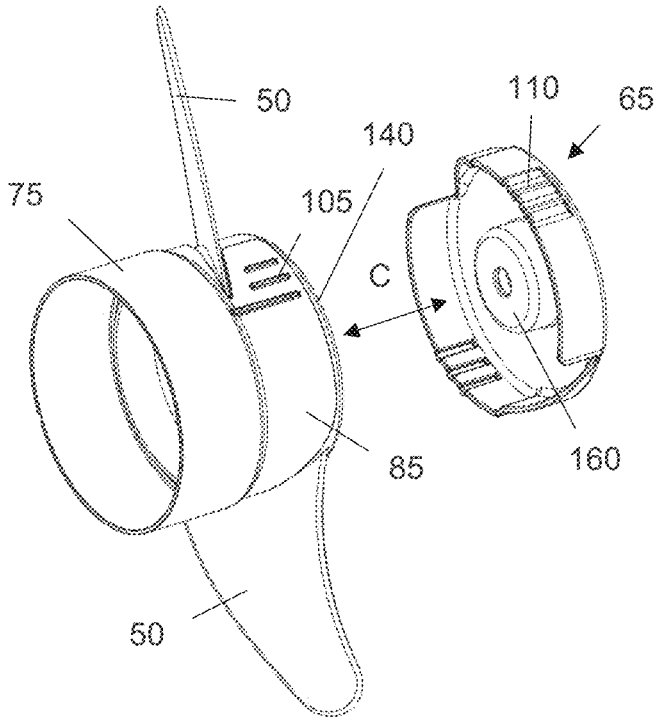

FIGS. 7*a*-7*d* illustrate one method of assembling the disclosed adaptor on a boat motor propeller. Particularly, as shown in FIG. 7*a*, first adaptor shell 60 is positioned on a first side of propeller 30. In some embodiments, propeller recess 145 faces the adaptor. The two shells are then translated together, as shown by Arrow B to arrive at the joined configuration of FIG. 7*b*. As shown, propeller blades 50 extend through openings 115 of connector portion 85. Second adaptor shell 65 is then positioned to align with hub face 140 of the propeller. The second adaptor shell is translated towards the first adaptor shell such that ridges 105 fit into grooves 110, as indicated by Arrow C of FIG. 7*c*.

Figure 7D:
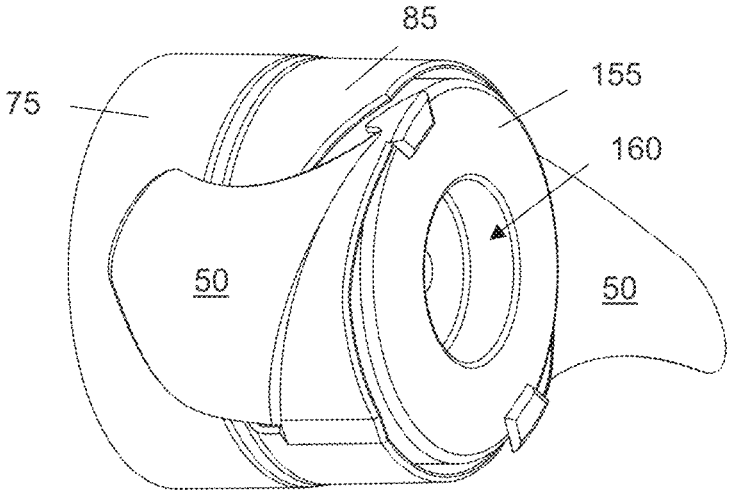

Alternatively, the first and second shells can be coupled together by connection to the drive shaft. In some embodiments, the second adaptor shell includes recess 160 that is sized and shaped to overlay with recess 145 of the propeller to create a nested arrangement. FIG. 7*d* illustrates the adaptor assembly configured around propeller 30. It should be appreciated that the disclosed adaptor can be assembled on a propeller in a variety of ways, and is not limited to the method set forth in FIGS. 7*a*-7*d*. It should further be appreciated that the assembly is not limited to the order of steps given herein above.

Figure 8A:
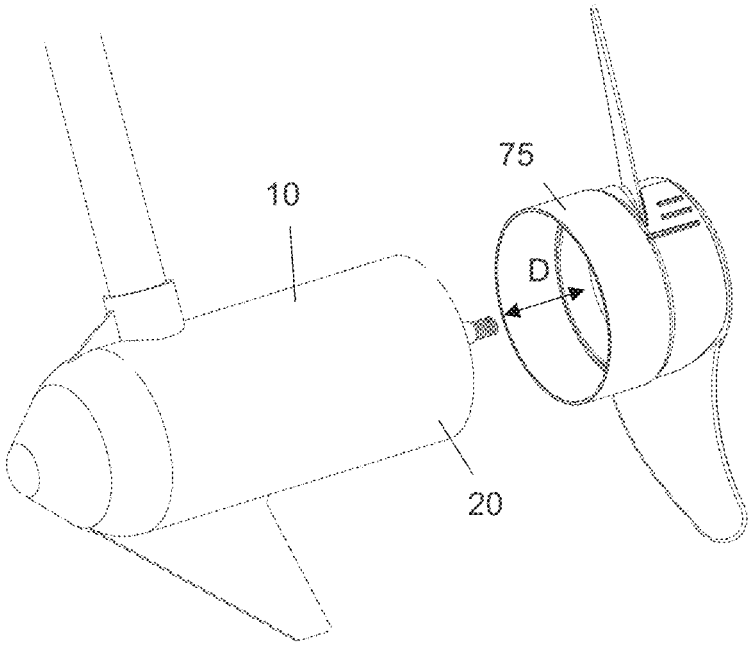
FIGS. 8*a*-8*f* are perspective views illustrating assembly of the adaptor on a trolling motor in accordance with some embodiments of the presently disclosed subject matter.
Figure 8B:
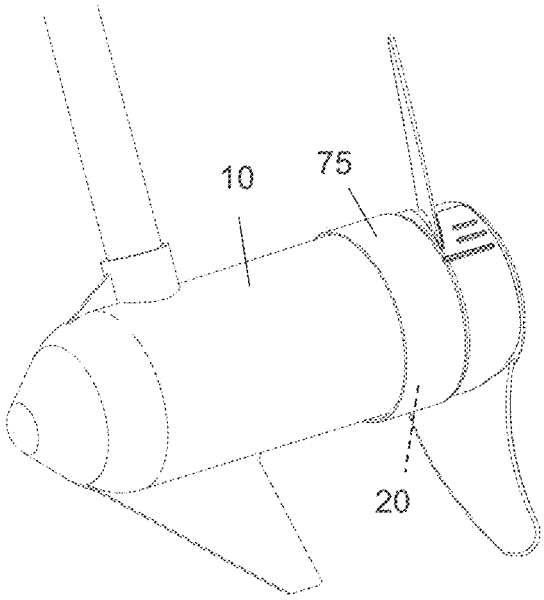
Figure 8C:
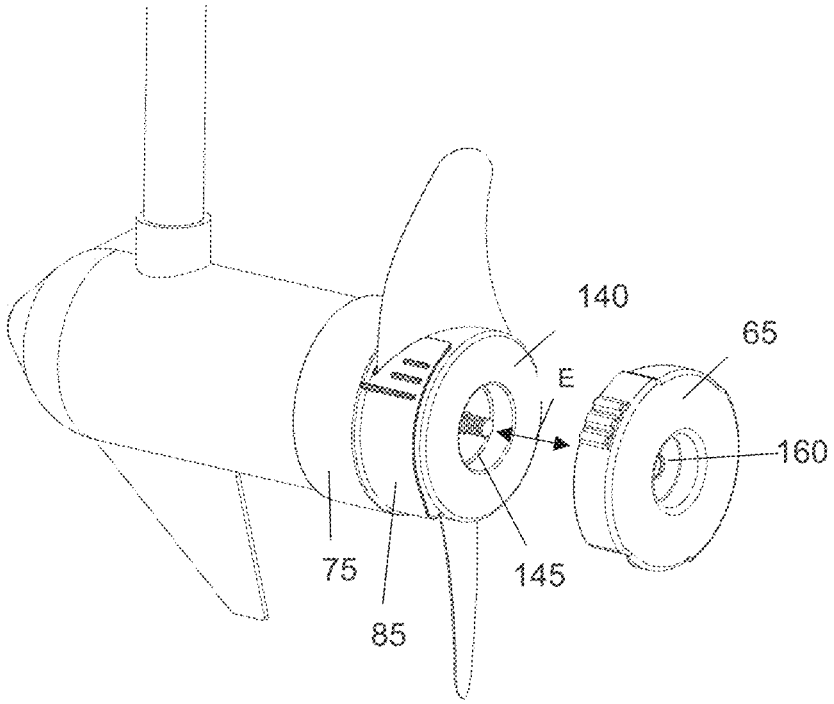
Figure 8D:
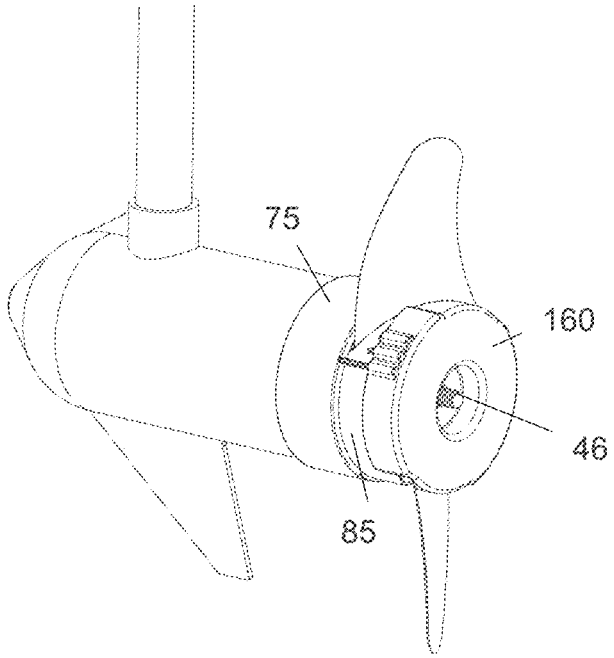
Figure 8E:
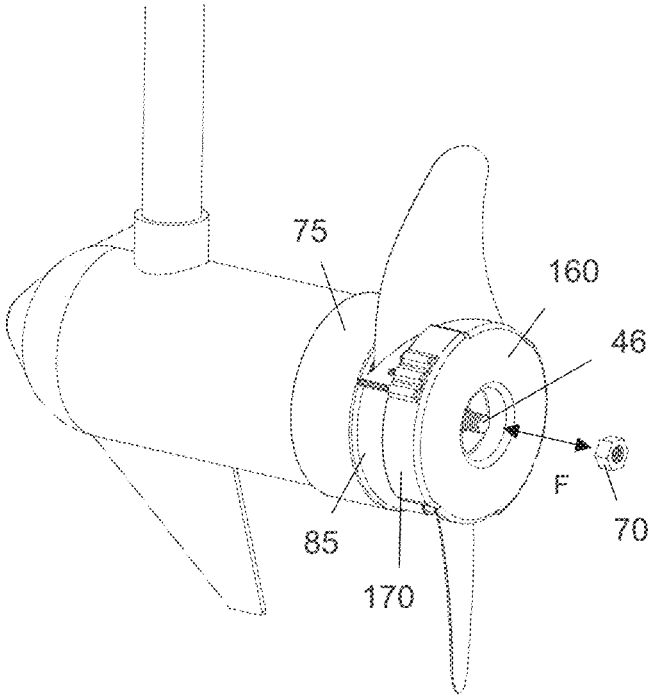
Figure 8F:
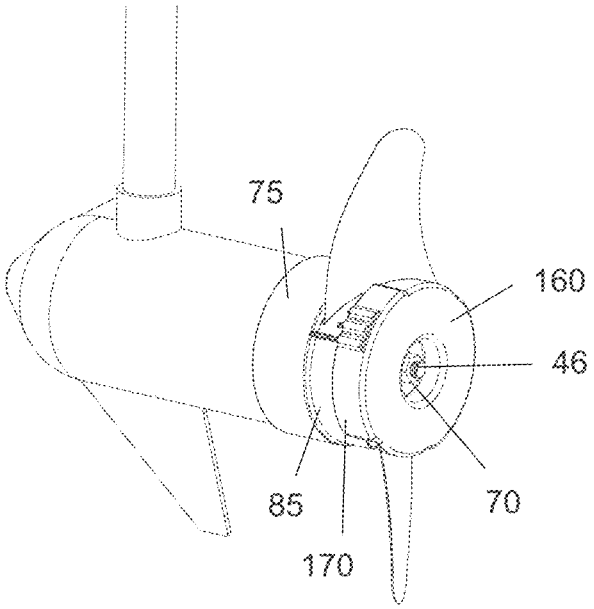

FIGS. 8*a*-8*f* illustrate one method of positioning the disclosed adaptor on the motor housing of a trolling motor. Specifically, first adaptor shell 60 can be attached to propeller 30, as set forth in detail above. Sleeve 75 of the first adaptor shell can then be configured over trailing end 20 of motor housing 10, as shown by Arrow D in FIG. 8*a* to arrive at the configuration of FIG. 8*b*. Alternatively, sleeve 75 can be configured over the trailing end of the housing as a first step, and then connected to propeller 30. In some embodiments, second adaptor shell 65 can then be positioned over propeller face 140, such that adaptor recess 160 nests into propeller recess 145, as illustrated by Arrow E of FIG. 8*c* to arrive at the configuration of FIG. 8*d*. As shown in FIG. 8*e*, drive shaft 46 extends through the open (hollow) center portion of the first adaptor shell, through hole 150 in the propeller, and through the hole in the second adaptor shell. Fastener 70 can then be attached to the drive shaft using methods well known in the art (e.g., screw threads), as shown by Arrow F of FIG. 8*e*. FIG. 8*f* illustrates a trolling motor configured with the disclosed adaptor assembly. As shown, gap 55 is eliminated. It should be appreciated that the disclosed assembly method is not limited, and can be performed in any order.

Figure 9A:
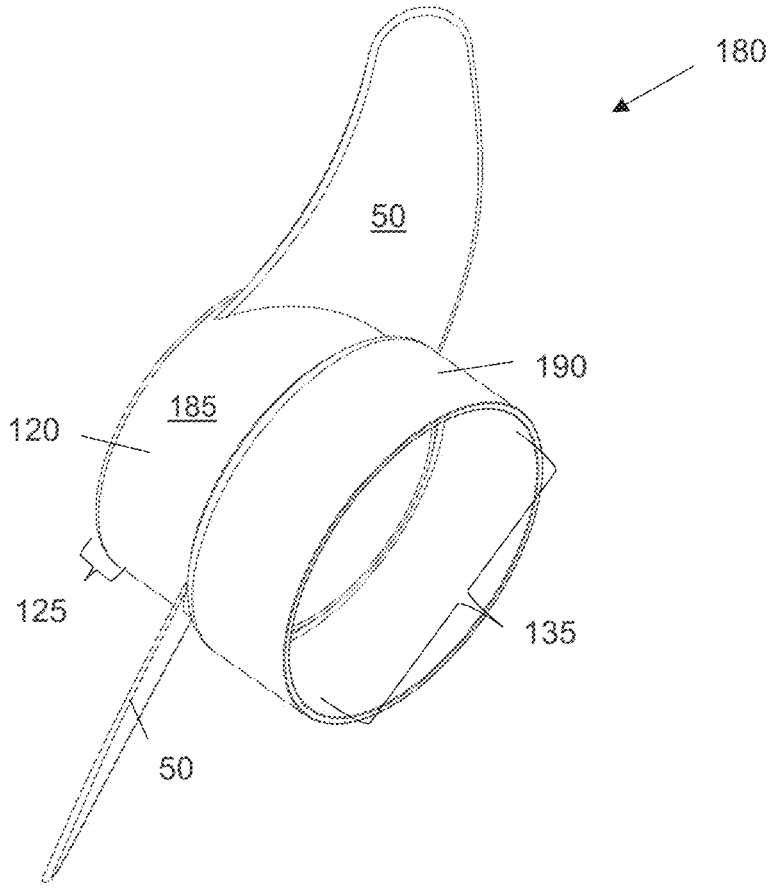
FIGS. 9*a* and 9*b* are perspective views illustrating an adaptor in accordance with some embodiments of the presently disclosed subject matter.
Figure 9B:
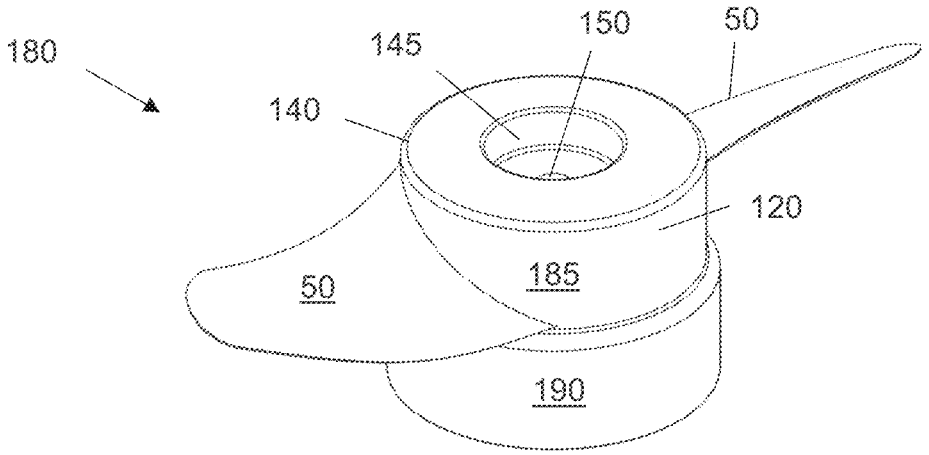

FIGS. 9*a* and 9*b* illustrate an alternate embodiment of the disclosed adaptor. As shown in FIG. 9*a*, integrated adaptor 180 includes propeller 185 and sleeve 190 molded or otherwise connected together. As shown, propeller 185 comprises hub 120 and a plurality of blades 50 extending radially outwardly from the hub. In some embodiments, hub 120 further includes hub face 140 positioned at front end 125 and recess 145 that extends from the face into cavity 135, towards sleeve portion 190. However, it should be appreciated that the hub face and recess are optional. Recess 145 can be configured with a circular cross-section that includes hole 150 for receiving a motor drive shaft. In use, sleeve 190 fits over trailing end 20 of a motor housing, such that the drive shaft extends through hole 150. A fastener is then attached to the drive shaft using methods well known in the art (e.g., screw threads) to secure the integrated adaptor to the motor housing. In some embodiments, the outer diameter of propeller 185 can be less than the outer diameter of sleeve portion 190, as shown in FIGS. 9*a* and 9*b*. However, the presently disclosed subject matter also includes embodiments wherein the outer diameters of the sleeve and propeller portions are about the same, or wherein the outer diameter of the sleeve portion is less than the outer diameter of the propeller portion.

Advantageously, the disclosed adaptor can be used to retrofit a conventional trolling motor structure to eliminate the gap between the motor housing and the propeller. As discussed above, the sleeve of the disclosed adaptor fits over the trailing end of the motor housing, thereby eliminating gap 55 at joint 45. The adaptor further encases the propeller, allowing full rotation of the propeller. As a result, the disclosed adaptor resists the migration of foreign matter between the motor housing and the propeller.

What is claimed is:

1. An adaptor comprising:

a first adaptor shell defining a sleeve that includes a connector portion that extends from an end thereof, the connector portion defining a cutout for receiving a blade of a propeller; and a second adaptor shell configured for engaging the first adaptor shell, wherein the second adaptor shell defining an end surface about which a fastener engages a rotating shaft that carries the propeller, and further defining a cutout for receiving the blade of the propeller when the first and second adaptor shells are thereby engaged with each other.

2. The adaptor of claim 1, wherein the second adaptor shell further comprises a wall that extends from the end surface that includes one or more attachments that connect to respective one or more attachments positioned on the connector portion of the first adaptor shell when the first and second adaptor shells are engaged with each other.

3. The adaptor of claim 2, wherein the attachments are connected together through friction fit, snap-fit, mechanical interlock, or combinations thereof.

4. The adaptor of claim 3, wherein the first adaptor shell attachments are configured as ridges and the second adaptor shell attachments are configured as grooves.

5. The adaptor of claim 1, wherein the connector portion has an outer diameter that is at least about 2% less than an outer diameter of the sleeve.

6. The adaptor of claim 1, wherein the end surface of the second adaptor shell comprises an aperture through which the rotating shaft can pass.

7. The adaptor of claim 1, wherein the cutouts are triangular-shaped.

8. A method of installing an adaptor on a boat motor that comprises a main cylindrical housing from which a drive shaft extends and a propeller comprising a hub and a plurality of blades extending from the hub; wherein the method comprises:

providing an adaptor comprising:

a first adaptor shell defining a sleeve that includes a connector portion that extends from an end thereof, the connector portion defining a cutout for receiving a blade of a propeller; and a second adaptor shell configured for engaging the first adaptor shell, wherein the second adaptor shell defining an end surface about which a fastener engages a drive shaft that carries the propeller, and further defining a cutout for receiving the blade of the propeller when the first and second adaptor shells are thereby engaged with each other;

attaching the first adaptor shell to the hub, wherein a blade extends through each cutout of the connector portion;

inserting the sleeve of the first adaptor shell over one end of the main cylindrical housing, wherein the drive shaft extends through an aperture in the propeller;

engaging the first adaptor shell and the second adaptor shell, wherein the drive shaft passes through the end surface of the second adaptor shell, wherein rotation of the propeller imparts a corresponding rotation to the sleeve.

9. The method of claim 8, wherein the second adaptor shell further comprises a wall that extends from the end surface that includes one or more attachments that connect to respective one or more attachments positioned on the connector portion of the first adaptor shell when the first and second adaptor shells are engaged with each other.

10. The method of claim 9, wherein the attachments are connected together through friction fit, snap-fit, mechanical interlock, or combinations thereof.

11. The method of claim 8, further comprising coupling a fastener to a portion of the drive shaft that extends from the end surface of the second adaptor shell.

12. The method of claim 8, wherein the connector portion has an outer diameter that is at least about 2% less than an outer diameter of the sleeve.

13. The method of claim 8, wherein the cutouts are triangular-shaped.

* * * * *